United States Patent [19]

Washburn

[11] 3,941,068

[45] Mar. 2, 1976

[54] THREAD CONTROL FOR OVEREDGE SEWING MACHINE

[75] Inventor: John M. Washburn, West Hartford, Conn.

[73] Assignee: The Merrow Machine Company, Hartford, Conn.

[22] Filed: Dec. 12, 1974

[21] Appl. No.: 532,147

[52] U.S. Cl. ..... 112/162; 112/241

[51] Int. Cl.[2] ..... D05B 57/06

[58] Field of Search ..... 112/162, 172, 177, 241

[56] References Cited

UNITED STATES PATENTS

| | | | |
|---|---|---|---|
| 932,272 | 8/1909 | Grieb | 112/162 |
| 1,663,488 | 3/1928 | Berger | 112/162 |
| 2,494,901 | 1/1950 | Rubel | 112/162 |
| 2,704,042 | 3/1955 | Wallenberg et al. | 112/162 |
| 3,688,711 | 9/1972 | Szostak et al. | 112/162 |

*Primary Examiner*—George H. Krizmanich

[57] ABSTRACT

A thread control mechanism for an overedge sewing machine uses only the movable driven components of the needle, lower looper, and upper looper, in combination with stationary thread guides, for feeding and controlling the threads used by the machine to form a seam. The lower and upper looper threads, i.e., the threads which pass through the eye of the lower and upper loopers, respectively, are each engaged by movable thread guides carried on the looper carriers for both loopers so that the coordinated movement of the two loopers cooperate to control and feed both looper threads. A needle thread takeup cam mounted on and driven by the needle arm drive shaft cooperates with stationary thread guides to feed and control the needle thread.

7 Claims, 5 Drawing Figures

THREAD CONTROL FOR OVEREDGE SEWING MACHINE

BACKGROUND OF THE INVENTION

1. Field of the Invention

This invention relates to thread handling and feeding mechanisms for sewing machines and more particularly to an improved mechanism for feeding and controlling the threads employed in an overedge sewing machine of the type employed to form an overedge seam along the edge of a workpiece.

2. Description of the Prior Art

Overedge sewing machines of the type illustrated in copending U.S. Patent application Ser. No. 354,714, now U.S. Pat. No. 3,881,434, assigned to the assignee of the present invention, are commonly employed to form a seal with two or three threads. When two or three threads are employed for the seam, the problems of handling the threads, including controlling the feeding, tension, and timing of the takeup to draw the stitches tight, are greatly complicated as each thread must be controlled relative to the other threads in order to properly form a standard stitch seam.

Numerous threading arrangements have been developed in the past for controlling and feeding the threads of an overedge sewing machine, one example being illustrated in U.S. Pat. No. 2,949,901. However, these prior art thread control machines have generally not been readily adaptable to other machines. Further, many of them have not been easily threaded, requiring extensive down time for rethreading when a thread is broken, due to the relatively inaccessible location of portions of the thread control mechanism. Also, many of the prior art devices have been difficult to adjust to maintain proper control and tension in the threads.

SUMMARY OF THE INVENTION

This invention is primarily concerned with a thread handling mechanism for use in forming a three-thread seam on an overedge sewing machine of the type disclosed in the above-mentioned copending application, although the principles involved may also be employed in the formation of the two-thread seam. In such a machine, the lower looper is carried by a looper carrier mounted on a rock shaft which is driven to impart oscillatory movement to the looper and looper carrier in a plane transverse to the direction of movement of a workpiece through the machine. The upper looper is mounted on a driven upper looper carrier which is simultaneously reciprocated along and oscillated about its longitudinal axis in a generally spiral path to move the upper looper from a retracted position substantially level with the machine's work support plate and an extended position projecting above the work support plate. The needle is mounted on a needle arm carried by a rock shaft which is driven to oscillate the needle in a vertical plane parallel to the direction of movement of the workpiece. The needle is oscillated from a raised position spaced above the machine's work plate and lowered position projecting below the work plate.

In operation of a machine of the type described, the respective threads must be interlooped through and around the edge of the fabric or workpiece being sewn, with the respective loops being drawn or taken up with the proper tension to form the individual stitches. This necessarily requires the manipulation of lengths of the respective threads, upon formation of each complete stitch, which are substantially greater than the length required for each stitch in the finished seam, and an important consideration in the design of the thread handling mechanism is the maximum utilization of existing moving components of the machine to affect the feeding and takeup of the respective threads. It is also an important consideration that neither the size nor weight of these existing moving components be materially increased by the thread handling mechanism and that the thread handling mechanism does not materially contribute to the noise output of these existing driven components. It is therefore the primary object of the present invention to provide an improved thread handling mechanism for an overedge sewing machine which utilizes only the driven support members of the stitch forming elements, in combination with stationary thread guide means, to perform the thread feeding and takeup operations.

Another object of the present invention is to provide such a thread handling apparatus for an overedge sewing machine wherein a thread carried by one of the machine loopers is also engaged by thread guides carried by each of the looper carriers to affect takeup of the thread.

Another object of the invention is to provide an improved thread handling mechanism for use in an overedge sewing machine to form a three-thread seam wherein each of the machine's loopers carries a looper thread and wherein each looper thread is engaged by movable thread guides carried by both of the looper carriers which movable thread guides cooperate with stationary thread guides to affect takeup of the thread during the sewing operation.

In the attainment of the foregoing and other objects and advantages, an important feature of the present invention resides in passing the upper looper thread from a suitable feed tension control device through a stationary thread guide mounted on the machine frame, then successively through an eye in a first movable thread guide mounted on the upper looper carrier and an eye in a second movable thread guide mounted on the lower looper carrier. From the second movable thread guide, the upper looper thread passes through a second fixed thread guide mounted on the frame, then through the eye of the upper looper. Passing the upper looper thread through movable thread guides carried by each of the looper carriers, the synchronized movement of the two loopers maintains the thread under more uniform tension during the entire stitch forming operation, including the feeding as well as takeup of the thread, thereby avoiding uneven jerking motions and maintaining continuous control of the thread.

The lower looper thread also passes through a feed tension control mechanism and suitable stationary thread guides mounted on the machine frame, then through a second eye in the second movable thread guide mounted on the lower looper. The lower looper thread, however, does not pass through the eye in the first movable thread guide on the upper looper but rather passes from the second movable thread guide through the eye of a stationary thread guide located so that the length of the thread extending therebetween passes closely adjacent the upper looper carrier in position for the first movable thread guide to engage the thread during a portion only of its movement to deflect and therefore takeup the lower looper thread only during that portion of the movement of the upper looper. Again, the coordinated movement of the upper and lower loopers maintains continuous control, avoiding unnecessary jerking movement of the threads during the feeding and takeup operation.

BRIEF DESCRIPTION OF THE DRAWINGS

The foregoing and other objects and advantages will become more apparent from the following detailed description, taken with the drawings, in which.

DESCRIPTION OF THE PREFERRED EMBODIMENTS

Figure 1:
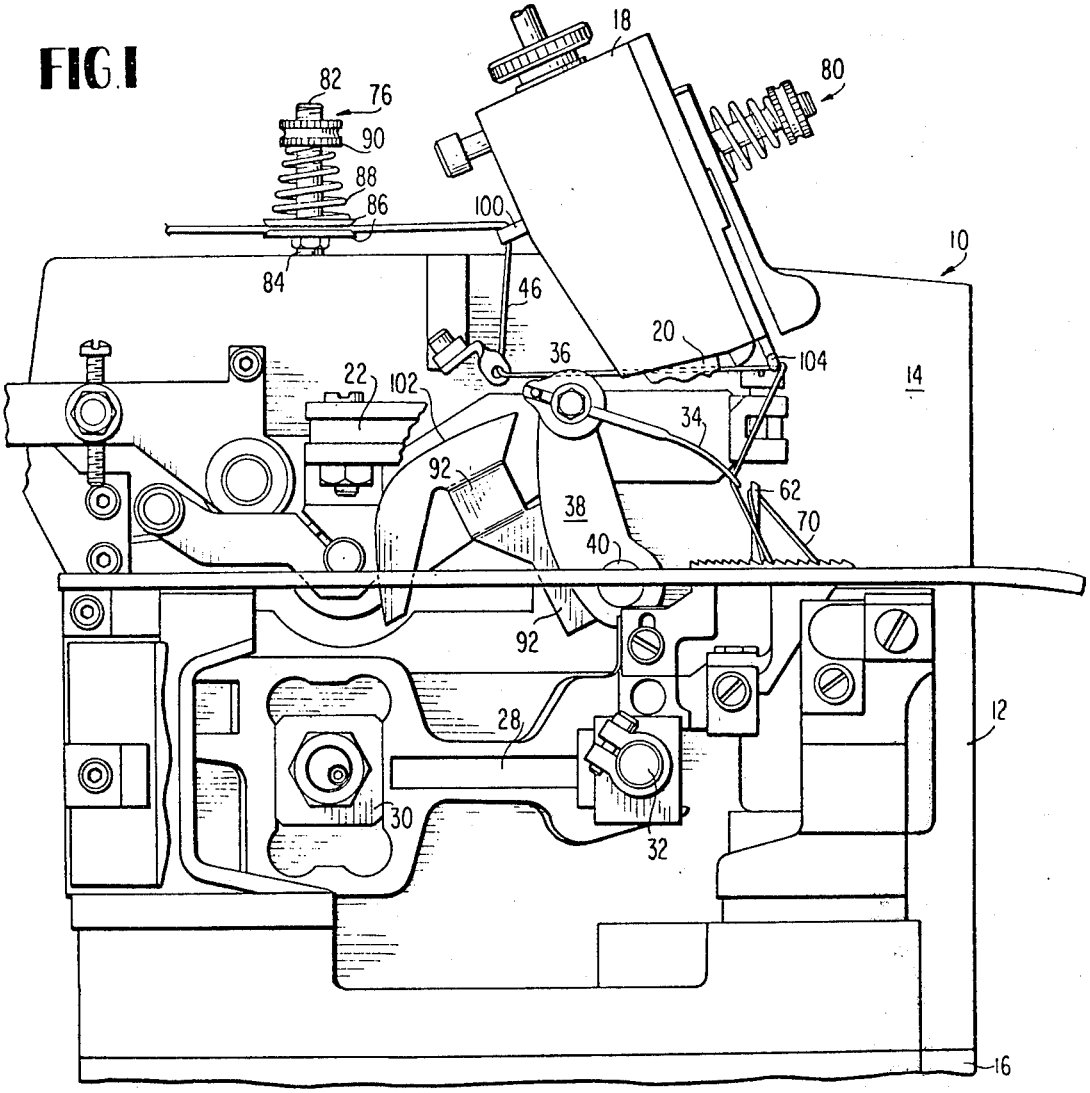
FIG. 1 is an end elevation view of an everedge sewing machine embodying the invention and illustrating the mechanism for feeding and taking up the needle thread.

Referring now to the drawings in detail, a sewing machine embodying the present invention is indicated generally by the reference numeral 10 and includes a housing consisting of a main frame 12 and top and bottom cover plates 14, 16, respectively. The main drive components of the machine are supported within the housing by the main frame 12 in the manner described in the above-mentioned copending application Ser. No. 354,714, the entire disclosure of which is incorporated herein by reference, and reference to which may be had for a more complete understanding of the operation of the specific elements of the machine structure.

The top cover plate 14 includes a support arm 18 which carries thereon a presser foot loading and release assembly including a spring loaded presser bar 20 for releasably urging the presser foot arm 22 in a direction to apply downward force to a workpiece passing through the machine. A portion of the presser foot arm 22 is shown in FIG. 1, with the remainder of the arm and the presser foot being broken away to more clearly show the thread handling components of the machine.

Materials to be sewn on the machine is fed over a work support plate 24 (FIG. 1) and needle plate (FIGS. 2–4) by a pair of driven feed dogs 26 in intermittent increments equal to the length of the successive stitches formed therein. Feed dogs 26 are each mounted on a feed carrier 28 which is reciprocated in a fore-and-aft direction by a scotch yoke assembly 30 and in a vertical direction by an eccentric on a feed raising shaft 32, the scotch yoke assembly and feed raising assembly cooperating to drive the feed dogs in a substantially elliptical path.

Figure 1A:
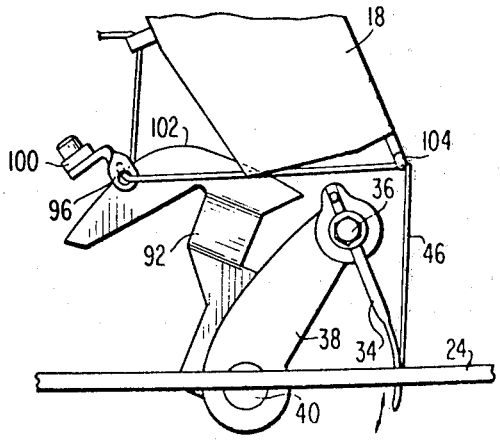
FIG. 1A is a fragmentary elevation view showing a portion of the structure of FIG. 1 in an alternate position.
Figure 2:
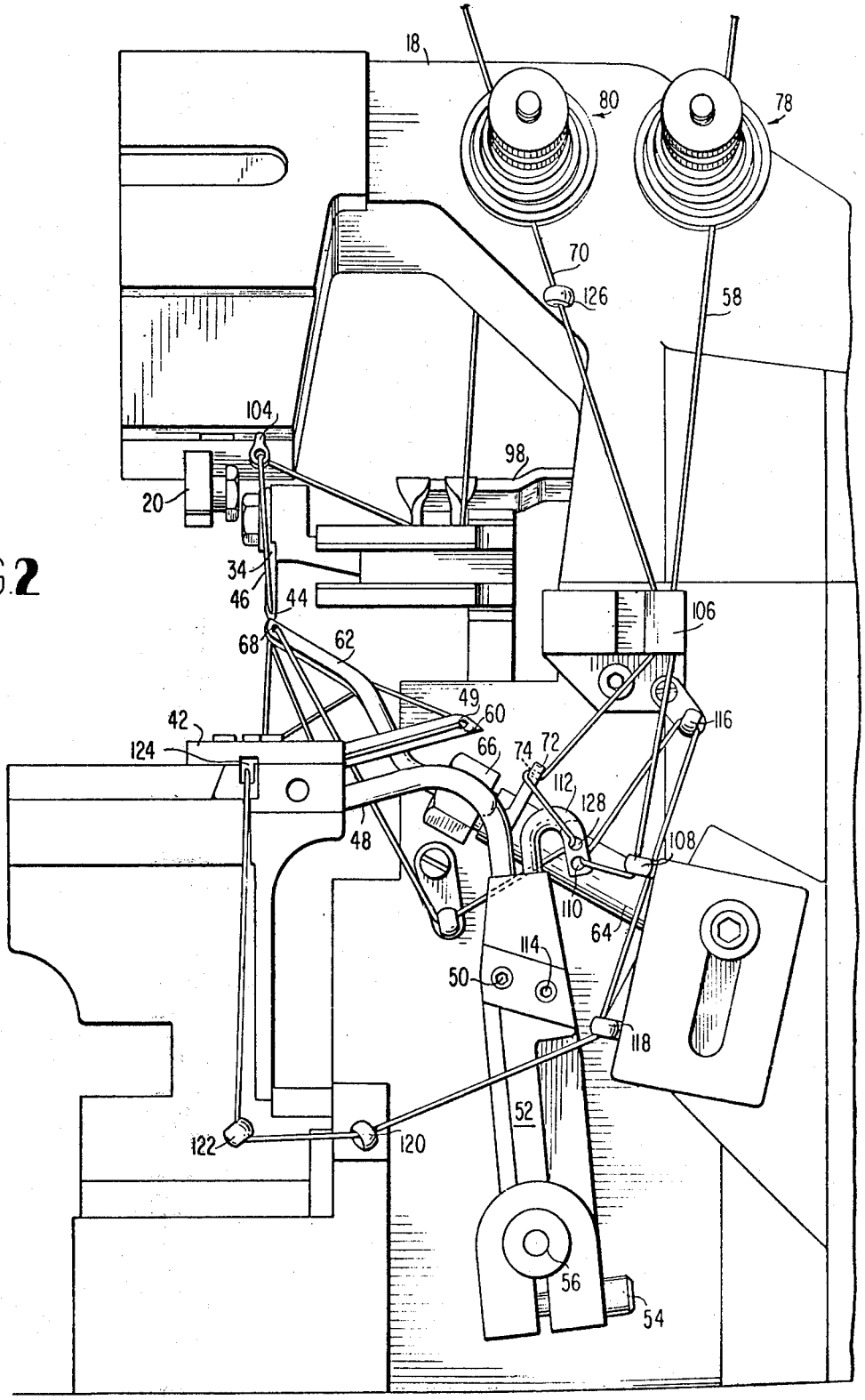
FIG. 2 is a front, or operator's position view, in elevation, of the machine shown in FIG. 1 and illustrating the thread handling mechanism for each of the three threads.

A curved sewing needle 34 is mounted, as by clamp 36, on the distal end of a needle carrier arm 38 which, in turn, is rigidly mounted on the end of a rock shaft 40 for movement therewith to oscillate the needle through a workpiece passing over the work support plate 24 and needle plate 42 and beneath the pressure foot, not shown, at the stitch forming station of the machine. The needle 34 has an opening, or eye 44, adjacent its end, and a needle thread 46 passes through the needle eye so that a loop of the thread is carried through a workpiece and beneath the needle plate 42 upon each down stroke of the needle as shown in FIG. 1A. During operation of the machine, the loop of needle thread is picked off the needle beneath the needle plate 42 by a lower looper 48 which is mounted, as by set screw 50 on the upwardly directed free end of a lower looper carrier arm 52. The lower looper carrier 52 has a split-ring clamp integrally formed thereon and is rigidly mounted, as by bolt 54, on the end of a rock shaft 56 projecting outwardly from the front wall of frame 12. The rock shaft 56 extends parallel to the vertical plane containing the needle 34 and needle carrier arm 38 and perpendicular to the vertical plane containing the needle rock shaft 40. Thus, oscillation of the rock shaft 56 moves the looper 48 in an arcuate path adjacent to and across the path of the needle 34 so that a lower looper thread 58 extending through an eye 60 in the free end of looper 48 will be carried through the loop of thread picked off from the needle beneath the needle plate. The open hook configuration of the lower looper, including the generally horizontal terminal arm portion 49 as best seen in FIG. 2, permits the arm 49 to project through the loop of needle thread so that a loop of the lower looper thread 58 is carried through the loop of needle thread.

Figure 3:
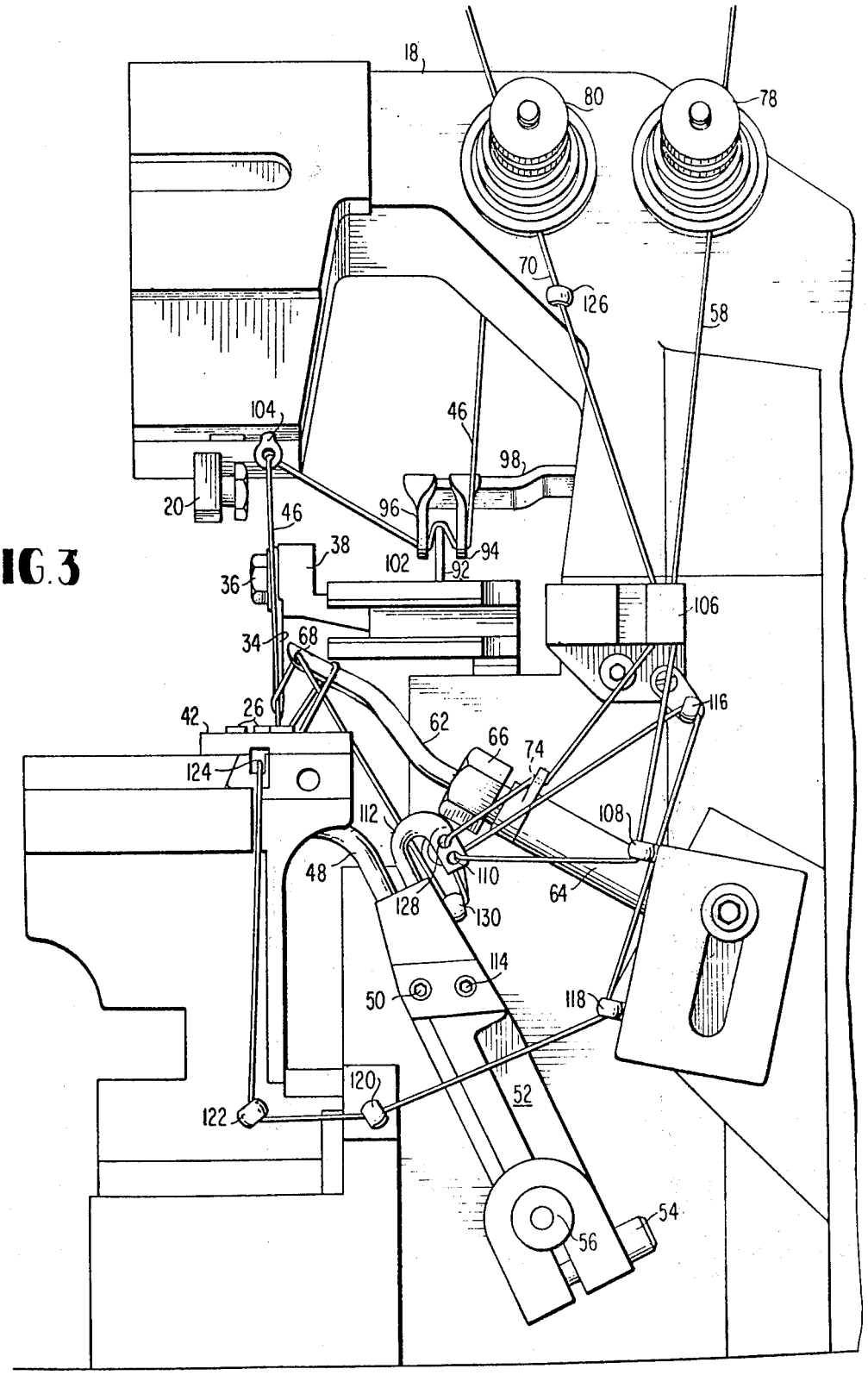
FIG. 3 is a view similar to FIG. 2 and showing certain of the elements in alternate positions; and, FIG. 4 is a further view similar to FIGS. 2 and 3 and illustrating the components in further alternate positions.
Figure 4:
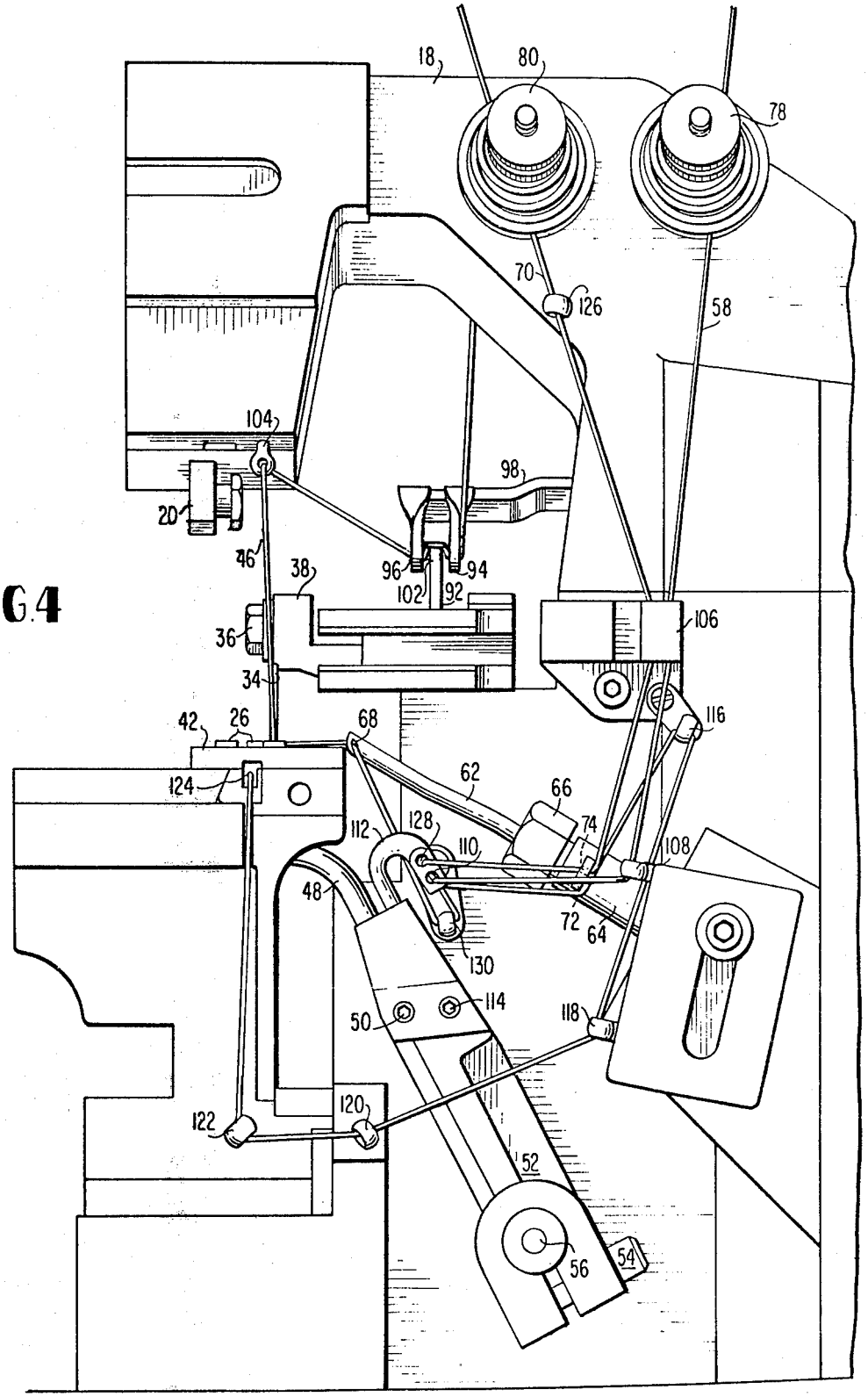

An elongated upper looper 62 has one end mounted on the end of an upper looper carrier 64 as by a clamping nut 66. As best seen in FIGS. 2 and 3, upper looper 62 is curved so that its free end is offset axially from the end mounted in the upper looper carrier 64, and a thread eye 68 extends through the free end of the looper 62 to carry an upper looper thread 70. The upper looper carrier 64 is slidably mounted in an axial bore of an elongated bearing sleeve, not shown, mounted and extending through an opening in the wall of frame 12. The upper looper bearing sleeve supports upper looper carrier 64 in a vertical plane parallel to and spaced forwardly of the axis of the needle rock shaft 40 and perpendicular to lower looper shaft 56 with the looper carrier 64 being inclined with respect to the horizontal at an angle of approximately 30°so that reciprocation through its bearing sleeve moves the free end of the upper looper 62 from a retracted position substantially level with and spaced to one side of the work support plate 42 as seen in FIG. 4 to an extending position projecting substantially above the work support plate as seen in FIGS. 1 and 2.

The upper looper carrier 64 has integrally formed thereon a laterally projecting finger-like thread guide 72 having an opening 74 extending therethrough for receiving the upper looper looper thread 70. The finger-like thread guide 72 projects in a generally upward and forward direction and is moved with the looper carrier both in its axial reciprocating and rotary oscillating movement as indicated in FIGS. 2–4.

The three threads employed by this machine, namely the needle thread 46, lower looper thread 58 and upper looper thread 70, are drawn from standard supply cones supported on a suitable thread stand, not shown. Three conventional thread tension devices 76, 78 and 80, respectively, are mounted on the machine housing for engaging and controlling the respective needle, lower looper and upper looper threads. The thread tension devices are identical and therefore only one will be described in detail. Thus, tension device 76 consists of an elongated, threaded stud 82 adapted to be threadably mounted in a suitable opening in the machine top cover 14. A nut 84 provides a shoulder on the stud 82 for engaging and supporting a pair of opposed, cooperating friction discs 86. A conical, compression spring 88 urges the pair of discs 86 together and against the shoulder provided by the nut 84, and a tension adjustment nut 90 is threadably mounted on the stud 82 to engage the top of the spring 88 to adjust the force applied to the spring to thereby control the tension of the thread which is passed between the opposing surfaces of the tension disc 86.

Referring now to FIGS. 1 and 1A, a needle thread takeup member 92 is mounted on rock shaft 40 for movement with the needle carrier 38. A pair of fixed thread guides 94, 96 are mounted in spaced relation to one another by a support arm 98, with the thread 46 passing from the tension device 76, through a fixed thread guide 100, then through openings in the respective thread guides 94, 96. The thread guides 94, 96 are spaced above and one to each side of the takeup member 92, with a cam surface 102 on the takeup member adapted to project upwardly between the respective thread guides to engage and deflect the length of thread 46 extending therebetween upon a portion of the oscillatory movement of the thread guide. From the thread guide 96, needle thread 46 passes through a further fixed thread guide 104 positioned in the vertical plane of the needle movement, then downwardly through an eye of the needle to the workpiece being sewn.

Referring to FIGS. 2–4, it is seen that the lower looper thread 58 passes through the tension device 78 downwardly through an opening in a thread guide 106 mounted on the front of the machine, on through a fixed thread guide 108, then through an opening 110 in a movable thread guide 112 mounted on the free end of lower looper carrier 52 by set screw 114. From the opening 110, thread 58 passes upwardly and through another fixed thread guide 116, then successively through fixed thread guides 118, 120 and 122, and finally through an opening in a guide tube 124 extending beneath the needle plate 42 to the opening 60 in the free end of lower looper 48. From the eye 60 in looper 48, the thread extends to the needle plate where the thread end in interlooped into the seam formed by the machine. As seen in FIGS. 2 and 3, the portion of lower looper thread 58 extending between thread guides 106, 108, 112 and 116 forms a triangle, when viewed from the front of the machine, with the movable thread guide 112 varying the size of the triangle as it oscillates with the lower looper 48 between its extended and retracted positions. However, when the lower looper is at or near its retracted position, the upper looper 62 moves to its retracted position so that guide 72 engages and deflects dowardly the portion of the lower looper thread 58 which corresponds generally to the hypontenuse of the triangle of thread. Thus, when the lower looper is in its retracted position, the maximum amount of lower looper thread is stored with the system of fixed and movable thread guides.

The upper looper thread 70 passes from the tension devise 80 through a fixed thread guide 126 mounted on the arm 18, then down through a second opening in fixed thread guide 106. From the thread guide 106, thread 70 passes through an opening in movable thread guide 72, then through a second opening 128 in movable thread guide 112 before passing through another fixed thread guide 130 and the eye 68 in the free end of upper looper 62.

In the formation of a three-thread seam with the machine according to the present invention, a shorter length of needle thread 46 is required than for either of the looper threads, it requiring only a length equal to a double loop of thread passing through the material increased by the length of the individual stitches along the length of the seam. Further, a relatively short length of needle thread is required for manipulation in the formation of each individual stitch so that relatively little takeup is required to properly draw up the stitch, with the final takeup being applied by the needle directly when in its fully retracted or raised position as shown in FIG. 1. Thus, the shape of the cam surface 102 engaging the length of needle thread between thread guides 94, 96 cooperates with the movement of the needle 34 to feed and control the needle thread throughout the formation of each of the successive stitches in the seam. When the needle is at the bottom of its stroke (slightly below the position shown in FIG. 1A) it has pulled off the largest amount of thread during the cycle, and the rear portion of the cam surface 102 is out of contact with the length of thread between thread guides 96, 96. In this position, the lower looper commences its movement from the retracted to the extended position, passing the point of the looper arm 19 through the loop of thread held by the needle to pick off the loop of needle thread. This excess needle thread must be taken up upon retraction of the looper arm 49 leaving only that amount of thread necessary to form the stitch. This is accomplished intitially by the cam surface 102 on takeup 92 as the needle commences its upward stroke since the point of the needle passes essentially along the line of the thread during this portion of the needle movement. Thereafter, as the needle approaches the fully retracted position, the point of the needle draws the needle thread rearwardly in the manner illustrated in FIG. 1 and the cam surface 102 is again moved out of contact with the thread.

When lower looper 48 is in its fully retracted position as illustrated in FIG. 4, the maximum amount of lower looper thread 58 has withdrawn and is stored in the system between thread guides 108, 112, 72 and 116, this excess stored thread being required to provide an adequate loop to be passed through the loop of needle thread and interlooped with upper looper thread 70. As the lower looper moves from its fully retracted position, the loop of needle thread 46 projecting beneath the needle plate, and which has been picked off by the lower looper, slides along the generally horizontal upper arm portion 49 (see FIG. 2) so that a relatively long loop of lower looper thread 58 is carried laterally and upwardly in position to be penetrated and picked off by movement of the upper looper 62.

Movement of lower looper 48 to its fully extended position shown in FIG. 2 brings thread guides 166, 108 and 110 into their closest proximity, thereby reducing to the minimum the amount of thread stored in the triangle extending between these three thread guides. At the same time, upper looper 62 has projected forwardly sufficient to move thread guide 72 out of contact with the lower looper thread 58, thereby permitting the thread to extend in a straight line between the opening 110 and thread guide 112 and guide 116.

In FIG. 2, the upper looper 62 is in its fully extended position, positioning a loop of upper looper thread 70 above needle plate 42 to be picked off by the needle 34 in its downward stroke. In this position of the upper looper, the maximum amount of looper thread 70 is withdrawn, with the excess consisting essentially of the loop of thread positioned above the needle plate. Also as this time, the thread guide 72 and the eye 148 of thread guide 112 are relatively close to one another and spaced between thread guide 106 and thread guide 130 to require the minimum length of thread extending between these fixed thread guides. As the upper looper 62 is retracted, as seen in FIG. 3, the amount of thread in the loop picked off by the needle is stubstantially reduced, and this excess thread is taken up by movement of the looper carriers and the thread guides carried thereby relative to one another and relatively to the fixed thread guides 106 and 130. When the loopers 48 and 62 each reach their fully retracted position as shown in FIG. 4, all excess upper looper thread 70 is taken up in the tortuous path between the thread guides carried by the two looper carriers and the stationary thread guides 106 and 130.

From the above, it is seen that the movable thread guides mounted on the lower looper carrier and the upper looper carrier cooperate to provide all of the take up required in each of the looper threads. However, the take up of the respective looper threads is independent so that the takeup mechanism is adaptable to the formation of either a two-thread seam or a three-thread seam.

While I have disclosed and described a preferred embodiment of my invention, I wish it understood that I do not intend to be restricted solely thereto, but that I do intend to include all embodiments thereof which would be apparent to one skilled in the art and which come within the spirit and scope of my invention.

What is claimed is:

1. In an overedge sewing machine including a frame, a thread-carrying needle, a needle arm supporting said needle for oscillatory movement in a first vertical plane extending in the direction of movement of work through the machine, a thread-carrying lower looper, a lower looper carrier supporting said lower looper for oscillatory movement in a second vertical plane extending at right angles to said first vertical plane, an upper looper, an upper looper carrier supporting said upper looper for recripocal and oscillatory movement along a line disposed in a third vertical plane extending parallel to said second vertical plane, means driving said needle arm and said lower and upper looper carriers to move said needle and said loopers in synchronization with one another to interloop the threads carried thereby to form an overedge seam, and first thread takeup means for controlling the thread carried by said lower looper, said first thread takeup means comprising spring biased thread tension means mounted on said frame, a plurality of stationary thread guides mounted on said frame, a first movable thread guide mounted on said lower looper carrier for oscillatory movement therewith, a second movable thread guide mounted on said upper looper carrier for oscillatory and reciprocal movement therewith, said first movable thread guide including means adapted to engage the thread carried by said lower looper during its oscillatory movement, said second movable thread guide including means movable in a path to engage a length of thread extending between two of the other of said thread guides during at least a portion of said oscillatory and reciprocal movement, said first and second movable thread guides cooperating with said tension means, said stationary thread guides, and said lower looper to control takeup of the lower looper thread.

2. In an overedge sewing machine as defined in claim 1, the further improvement wherein said first movable thread guide has an eye formed therein for receiving the lower looper thread therethrough.

3. In an overedge sewing machine as defined in claim 2, wherein said second movable thread guide comprises an elongated finger projecting outwardly from said upper looper carrier in position to engage and deflect the lower looper thread extending between said eye in said first movable thread guide and one of said stationary thread guides during a portion only of said oscillatory and reciprocal movement of said upper looper.

4. In an overedge sewing machine as defined in claim 1, wherein said upper looper is also a thread-carrying looper, said machine further comprising second thread takeup means for controlling takeup of the thread carried by said upper looper, said second takeup means including a second plurality of stationary thread guides mounted on said frame and said first and said second movable thread guides, said first and said second movable thread guides each having an eye extending therethrough for receiving and guiding the upper looper thread in its path between two of said stationary thread guides.

5. The overedge sewing machine as defined in claim 4, wherein said first movable thread guide has a pair of openings formed therein, one receiving and guiding said lower looper thread and the other receiving and guiding the upper looper thread.

6. The overedge sewing machine as defined in claim 5, wherein said second movable thread guide comprises an elongated finger projecting outwardly from said upper looper carrier in position to engage and deflect the lower looper thread extending between said first movable thread guide and one of said stationary thread guides during a portion only of said oscillatory and reciprocal movement of said upper looper.

7. The overedge sewing machine as defined in claim 6, further comprising third thread takeup means for taking up said needle thread, said third takeup means comprising a pair of laterally spaced, fixed thread guides each having an eye formed therein for receiving a length of the needle thread, and movable cam means mounted for oscillatory movement with said needle arm for engaging said length of said needle thread between said two laterally spaced thread guides to engage and takeup said needle thread during at least a portion of said oscillatory movement of said needle.

* * * * *